US006566638B2

(12) United States Patent
Brown

(10) Patent No.: US 6,566,638 B2
(45) **Date of Patent: *May 20, 2003**

(54) HEATING SYSTEM FOR A COOKING APPLIANCE

(75) Inventor: John Scott Brown, Charleston, TN (US)

(73) Assignee: Maytag Corporation, Newton, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/902,655

(22) Filed: Jul. 12, 2001

(65) Prior Publication Data

US 2001/0038007 A1 Nov. 8, 2001

Related U.S. Application Data

(63) Continuation of application No. 09/650,417, filed on Aug. 29, 2000, now Pat. No. 6,291,888.

(60) Provisional application No. 60/153,224, filed on Sep. 13, 1999.

(51) Int. Cl.[7] ..... H05B 6/80

(52) U.S. Cl. ..... 219/681; 219/400; 219/685; 219/536; 126/21 A

(58) Field of Search ..... 219/681, 685, 219/400, 757, 761, 536, 537; 126/21 A

(56) References Cited

U.S. PATENT DOCUMENTS

| | | | | |
|---|---|---|---|---|
| 3,521,032 A | | 7/1970 | Heuss | |
| 4,154,861 A | | 5/1979 | Smith | 219/681 |
| 4,327,279 A | | 4/1982 | Guibert | |
| 4,397,875 A | | 8/1983 | Gilliom | |
| 4,455,478 A | | 6/1984 | Guibert | |
| 4,480,164 A | | 10/1984 | Dills | 219/681 |
| 4,503,760 A | | 3/1985 | Pryputsch et al. | |
| 4,827,106 A | | 5/1989 | Margraf | |
| 4,940,869 A | | 7/1990 | Scholtes et al. | 219/681 |
| 5,066,851 A | | 11/1991 | Darvin | |
| 5,089,679 A | | 2/1992 | Eke | 219/400 |
| 5,107,126 A | | 4/1992 | Yano | 219/761 |
| 5,339,726 A | | 8/1994 | Poulson | |
| 5,615,603 A | | 4/1997 | Polin | |
| 5,641,420 A | * | 6/1997 | Peterson et al. | 219/536 |
| 5,662,029 A | | 9/1997 | Ubert et al. | 219/400 |
| 5,717,192 A | | 2/1998 | Dobie et al. | |
| 6,060,701 A | | 5/2000 | McKee et al. | 219/681 |
| 6,291,808 B1 | * | 9/2001 | Brown | 219/681 |

FOREIGN PATENT DOCUMENTS

| | | | |
|---|---|---|---|
| DE | 3931 482 | 4/1991 | 219/681 |
| JP | 3-144219 | 6/1991 | 219/681 |

* cited by examiner

*Primary Examiner*—Philip H. Leung

(57) ABSTRACT

A convection cooking appliance includes an oven cavity surrounded, at least in part, by an air channel assembly. The appliance includes at least first and second heating units arranged in the air channel assembly, as well as an additional heating unit in the oven cavity. A blower assembly is provided to generate a recirculating flow of air through the air channel assembly and the oven cavity. A microwave generator and a catalyst are also arranged in the air channel assembly. A controller, responsive to operator inputs and signals from a temperature sensor extending into the air channel assembly, regulates the activation/deactivation state of each of the components based on a preprogrammed algorithm. One of the heating units in the air channel assembly is constituted by an open coil heating element, defined by a plurality of rows spaced in the direction of air flow downstream of the blower assembly. The arrangement of the coils functions to straighten the air flow for delivery to the oven cavity.

18 Claims, 4 Drawing Sheets

HEATING SYSTEM FOR A COOKING APPLIANCE

This application constitutes a continuation application of U.S. Ser. No. 09/650,417 filed Aug. 29, 2000, now U.S. Pat. No. 6,291,808, which claims the benefit of U.S. Provisional Application No. 60/153,224, filed Sep. 13, 1999.

BACKGROUND OF THE INVENTION

1. Field of the Invention

The present invention pertains to the art of cooking appliances and, more particularly, to a convection oven incorporating an open coil heating element arranged in an air flow path for the oven.

2. Discussion of the Prior Art

It is known in the art to utilize open coil heating elements to heat oven cavities. In general, multiple heating elements are provided within a single oven cavity for use in connection with baking, broiling and/or cleaning modes of operation. It has also been proposed in the art to incorporate a fan within the oven cavity to enhance the flow of heated air in order to provide for a more uniform temperature distribution within the oven.

Regardless of these known prior art arrangements, there exists a need for further enhancements in the heating of the air flow for a convection oven. More specifically, there exists a need in the art of cooking appliances for a convection oven arrangement with enhanced pre-heat capabilities. In addition, there exists a need for a convection oven heating arrangement which minimizes non-linear air flow patterns so as to optimize the overall heating characteristics of the system.

SUMMARY OF THE INVENTION

In accordance with the invention, a convection cooking appliance is provided with multiple heating units, with at least one being constituted by an open coil heating unit disposed outside an oven cavity of the cooking appliance. More particularly, the heating unit is disposed in an upper duct section of an air channel assembly which extends about and is in fluid communication with the oven cavity. A flow of air is directed through the channel assembly by a blower. In the most preferred form of the invention, the heating unit is centered in the air flow stream and arranged continuous from side-to-side. The heating unit preferably defines a single coil extending in various rows, with each of the coil rows being arranged substantially perpendicular to the flow of air. With this configuration, the heating unit tends to interrupt any developing patterns of air flow other than a linear flow in a desired direction.

Another heating unit of the system is positioned within the air flow assembly, while a third heating unit is arranged within the oven cavity. In addition, a microwave generator is provided, preferably below the oven cavity. Furthermore, a catalyst is located in the air channel assembly upstream of the blower. A controller is provided to regulate the activation and deactivation of each of the heating units, as well as the blower and the microwave generator, based on operator inputs and signals received from a temperature sensor to enable the cooking appliance to be operated efficiently in various cooking modes.

Additional objects, features and advantages of the present invention will become readily apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
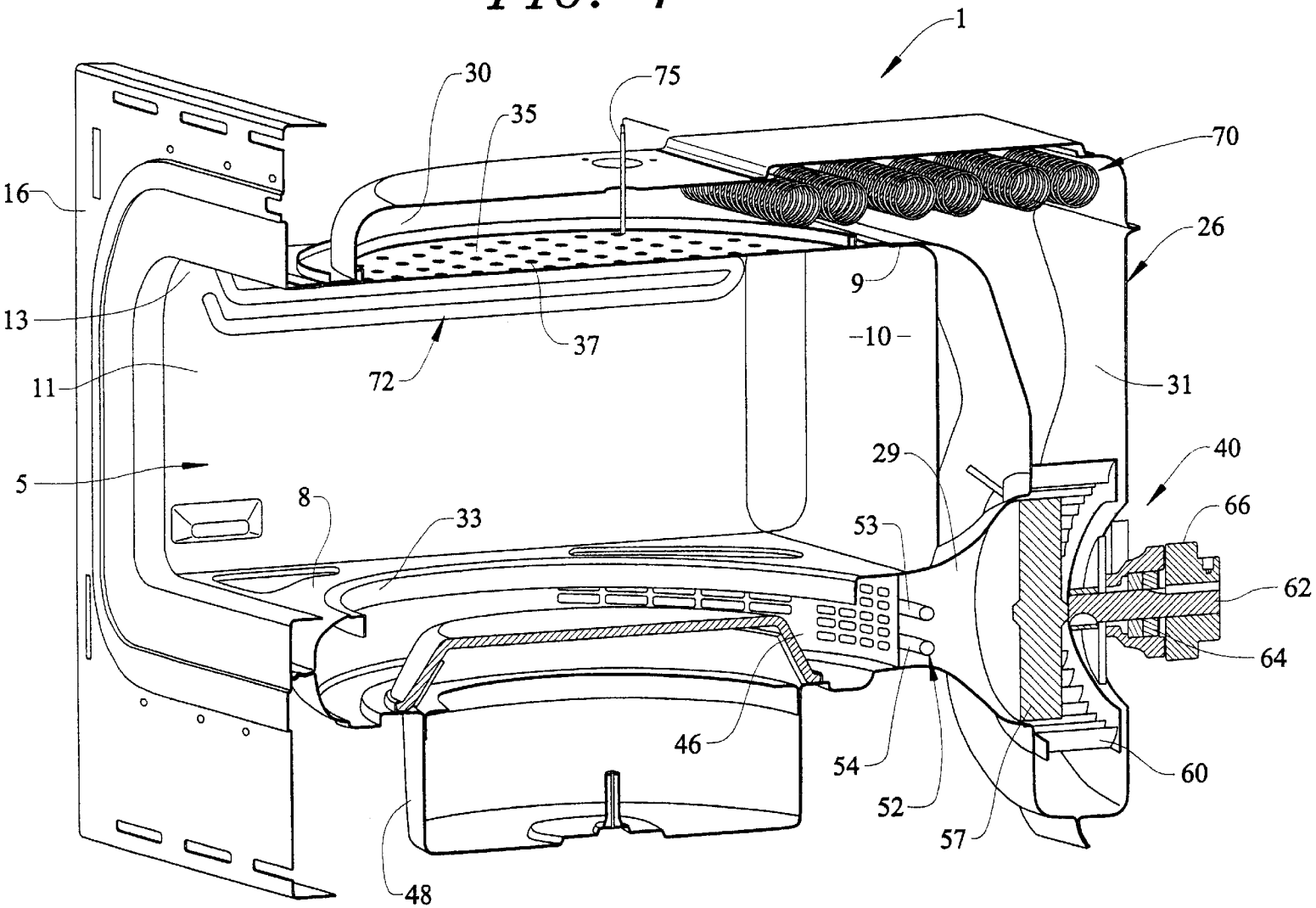
FIG. 1 is a perspective, partial sectional view of a convection cooking appliance constructed in accordance with the present invention.
Figure 2:
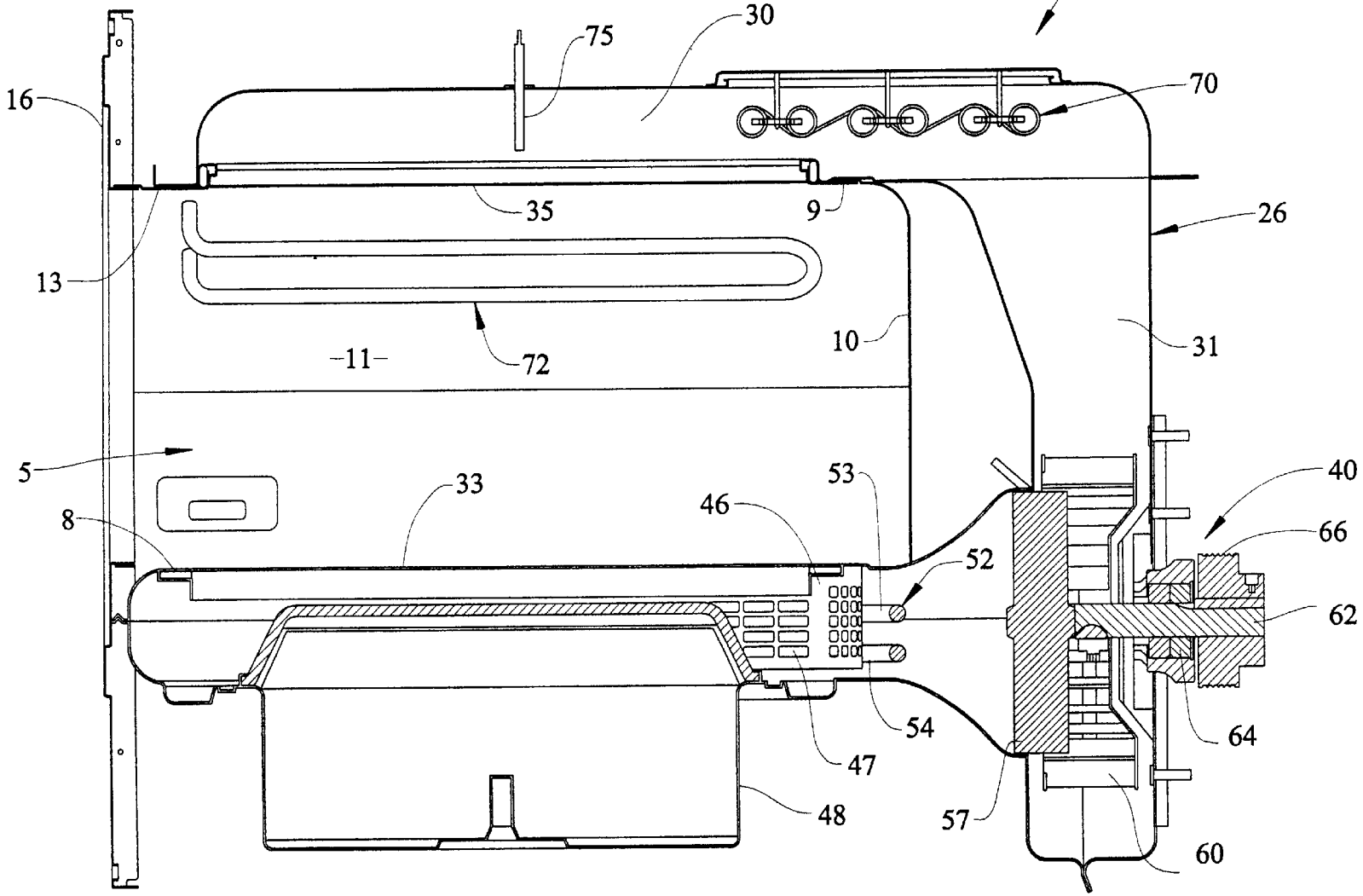
FIG. 2 is a cross-sectional side view of the cooking appliance of FIG. 1.
Figure 3:
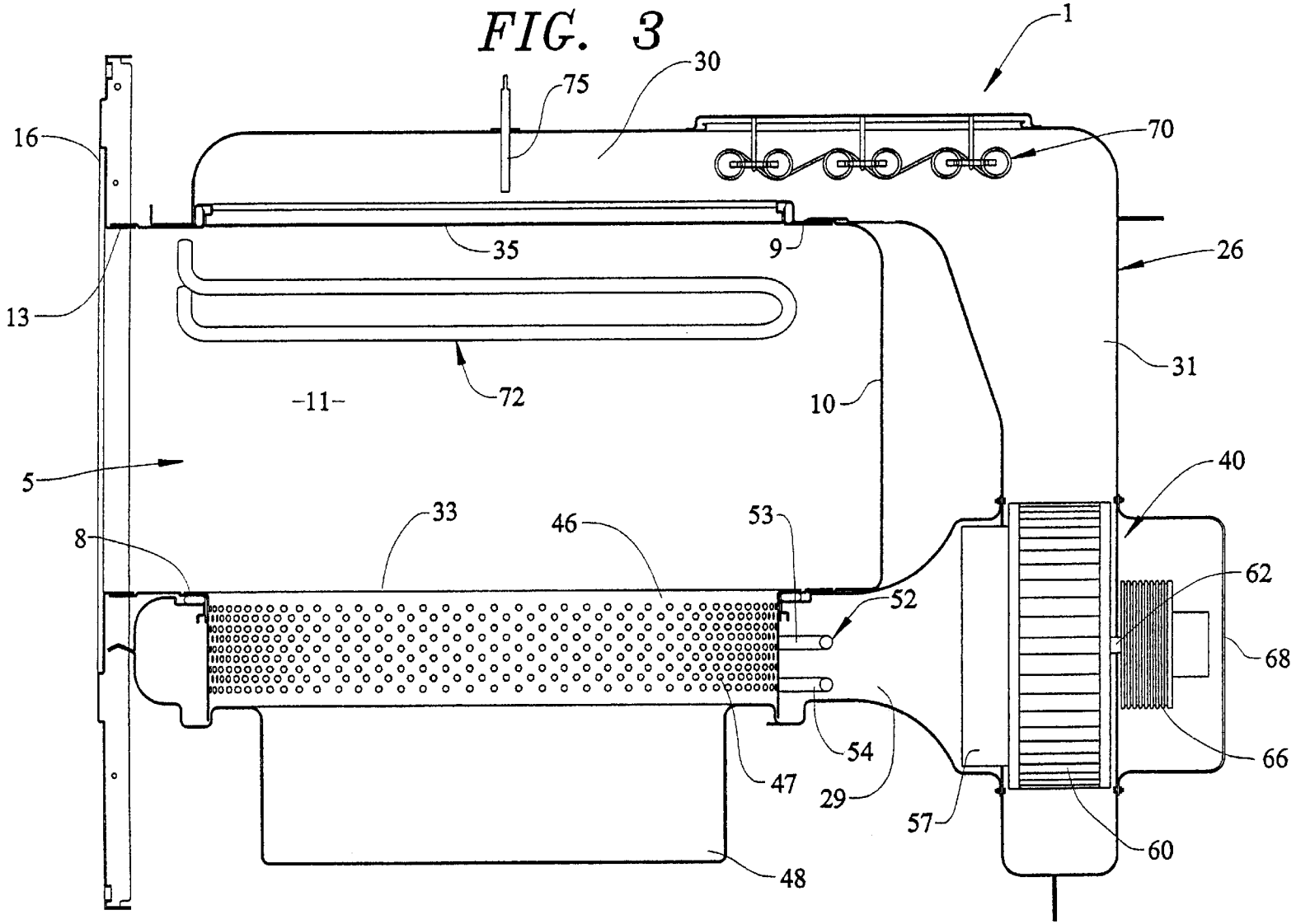
FIG. 3 is a schematic side view, similar to that of FIG. 2, of the cooking appliance.

With initial reference to FIGS. 1–3, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in U.S. patent application Ser. No.09/649,957 "OVEN CAVITY CONSTRUCTION" filed Aug. 29, 2000 U.S. Pat. No. 6,373,037 Which is hereby incorporated by reference.

In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed.

Arranged below filter basket 46 is a microwave generator unit 48 incorporating a magnetron and mode stirrer (both not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of open heating coils. Most preferably, second heating unit 70 is defined by a single open electric coil arranged in multiple rows, with each row running back and forth across essentially the entire width of upper air delivery section 30 so as to be substantially perpendicular to the direction of flow through upper air delivery section 30. In any event, second heating unit 70 functions to further heat the air flowing through channel assembly 26 prior to the air reaching discharge inlet 35 as will be more fully discussed below.

Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for a cleaning mode of operation is detailed in U.S. patent application entitled "SELF-CLEANING SYSTEM FOR A COOKING APPLIANCE" filed on even date herewith and incorporated by reference.

Figure 4:
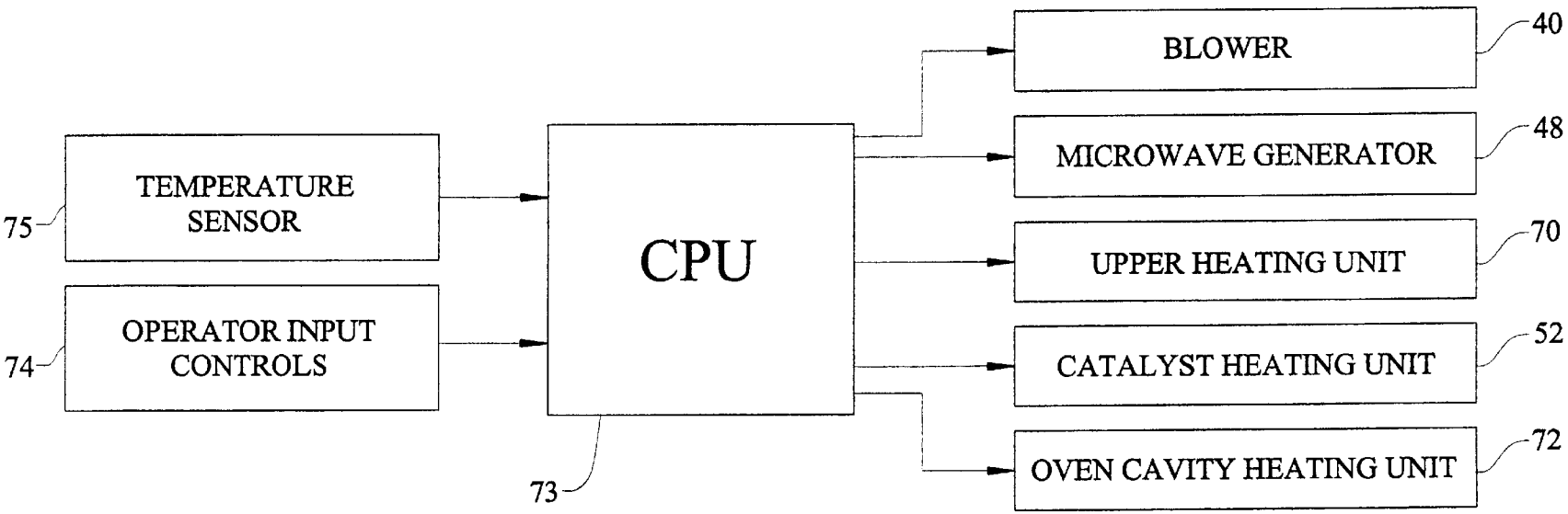
FIG. 4 is a block diagram illustrating a control arrangement used in the convection cooking appliance of the invention.

As represented in FIG. 4, each of blower assembly 40, microwave generator 48 and first, second and third electric heating units 52, 70 and 72 are linked to an appliance controller or CPU 73 and regulated based on established operator settings input at 74, as well as signals received from a temperature sensor 75. The present invention is particularly directed to the manner in which cooking appliance 1 can be effectively operated in various modes, as well as the manner in which the heating system directly affects the flow of air within channel assembly 26.

First of all, a user of cooking appliance 1 can select, through operator input controls 74, a convection cooking mode wherein heating element 52 is initially activated, along with blower assembly 40 and heating unit 70, to direct a flow of recirculating air through oven cavity 5. With this arrangement, heated air will be caused to flow within air channel assembly 26 and through holes 37 in order to impinge on food items to be cooked within oven cavity 5. During operation, blower assembly 40 can produce a certain degree of turbulence which is considered detrimental to the uniform and consistent flow of air through channel assembly 26. However, as indicated above, heating unit 70 is preferably constituted by various rows of open coils, with six rows of coils being shown in the preferred embodiment depicted in the drawings. Since the coils are open and arranged perpendicular to the flow of air, any turbulence developed by the operation of blower assembly 40 is transformed into a linear or laminar flow which enhances a smooth and continuous flow through oven cavity 5 for uniform heating.

During a convection cooking mode of operation, heating unit 70 can be cycled on and off by controller 73 in dependence on the temperature of the air as signaled by sensor 75. Within the spirit of the invention, heating unit 70 can also be variably controlled, such as by establishing low, medium or high wattage settings. Although not shown, heating unit 70 is preferably, electrically linked to controller 73 through the use of a triac. Regardless of the particular operating status of heating unit 70, blower assembly 40 and heating unit 52 are operated continuously throughout the convection cooking mode in accordance with the most preferred embodiment of the invention.

The user of cooking appliance 1 can also select a microwave cooking mode wherein controller 73 activates generator 48. Again, heating unit 52 is preferably, continuously operated whenever cooking appliance 1 is operational. Furthermore, in a cleaning mode, each of heating units 52, 70 and 72 are controlled for effective preheating and high temperature operation as covered by the copending application referenced above.

Although described with respect to a preferred embodiment of the invention, it should be recognized that various changes and/or modifications can be made to the invention without departing from the spirit thereof. It should be recognized that the heating system of the invention includes numerous heat sources which combine to produce synergistic results in various modes of operation. Therefore, cooking appliance 1 is versatile and can be effectively operated to perform a range of cooking functions in an efficient manner. In any event, the invention is only intended to be limited by the scope of the following claims.

I claim:

1. In a cooking appliance including an oven cavity adapted to be used in convection cooking of food products, a heating system comprising:

an air channel assembly extending about at least a portion of and being in fluid communication with the oven cavity;

a blower element for developing a flow of air within the air channel assembly for delivery to the oven cavity; and a heating unit positioned in the air channel assembly for heating the flow of air prior to entry into the oven cavity, said heating unit being constituted by a bank of open, electric heating coils defining a plurality of electrically interconnected rows extending transversely across the air channel assembly, with the plurality of rows being located downstream of the blower element and sequentially arranged entirely between the blower element and the oven cavity.

2. The heating system according to claim 1, wherein each of the plurality of rows extends substantially perpendicular to a direction of travel of the flow of air.

3. The heating system according to claim 2, further comprising: an additional heating unit positioned in the air channel assembly upstream of the blower element.

4. The heating system according to claim 3, further comprising: a catalyst arranged between the additional heating unit and the blower element.

5. The heating system according to claim 3, further comprising: a microwave generator, said additional heating element extending annularly about a portion of the microwave generator.

6. The heating system according to claim 2, further comprising: a temperature sensor for sensing an operating temperature of the cooking appliance.

7. The heating system according to claim 6, wherein the temperature sensor is arranged in the air channel assembly.

8. The heating system according to claim 1, wherein the bank of open, electric heating coils is constituted by a single open electric coil traversing back and forth across essentially an entire width of an upper air delivery section of the air channel assembly.

9. The heating system according to claim 1, wherein said bank of open, electric heating coils provides the flow of air in a laminar fashion for delivery to the oven cavity.

10. In a cooking appliance including an oven cavity adapted to be used in convection cooking of food products, a heating system comprising:

an air channel assembly extending about at least a portion of and being in fluid communication with the oven cavity;

a blower element for developing a flow of air within the air channel assembly for delivery to the oven cavity; and a heating unit positioned in the air channel assembly for heating the flow of air prior to entry into the oven cavity, said heating unit being constituted by a plurality of rows of open heating coils extending transversely across the air channel assembly so as to be substantially perpendicular to a direction of travel of the flow of air.

11. The heating system according to claim 10, wherein the plurality of rows are electrically interconnected and sequentially arranged between the blower element and the oven cavity.

12. The heating system according to claim 11, further comprising: an additional heating unit positioned in the air channel assembly upstream of the blower element.

13. The heating system according to claim 12, further comprising: a microwave generator, said additional heating element extending annularly about a portion of the microwave generator.

14. The heating system according to claim 10, further comprising: a catalyst arranged between the additional heating unit and the blower element.

15. The heating system according to claim 10, further comprising: a temperature sensor for sensing an operating temperature of the cooking appliance.

16. The heating system according to claim 15, wherein the temperature sensor is arranged in the air channel assembly.

17. The heating system according to claim 10, wherein the bank of open, electric heating coils is constituted by a single open electric coil traversing back and forth across essentially an entire width of an upper air delivery section of the air channel assembly.

18. The heating system according to claim 10, wherein said bank of open, electric heating coils provides the flow of air in a laminar fashion for delivery to the oven cavity.

* * * * *